United States Patent [19]

Hubachek

[11] 4,004,325

[45] Jan. 25, 1977

[54] KEY RING AND/OR CHAIN HOLDER

[76] Inventor: Louis H. Hubachek, 870 S. Gramercy Place, Los Angeles, Calif. 90005

[22] Filed: Aug. 6, 1975

[21] Appl. No.: 602,199

[52] U.S. Cl. ..... 24/3 K; 150/34; 248/205 A; 248/223; 248/224.3

[51] Int. Cl.[2] ..... A45C 11/32

[58] Field of Search ..... 150/40, 34; 248/224, 248/223, 205 A, 359, 360; 24/3 K; 70/457

[56] References Cited

UNITED STATES PATENTS

| | | | |
|---|---|---|---|
| 2,254,582 | 9/1941 | Schell | 150/40 X |
| 2,327,433 | 8/1943 | Johnson | 150/40 UX |
| 2,679,674 | 6/1954 | Hanna | 150/40 X |
| 3,326,258 | 6/1967 | Stucker | 150/34 |
| 3,350,045 | 10/1967 | Mayers | 248/205 A |
| 3,415,300 | 12/1968 | Worcester | 150/34 X |
| 3,682,216 | 8/1972 | Nelson | 150/34 X |
| 3,696,920 | 10/1972 | Lahay | 248/205 A X |
| 3,707,742 | 1/1973 | Justice | 150/40 X |

*Primary Examiner*—Donald F. Norton
*Attorney, Agent, or Firm*—Paul A. Weilein

[57] ABSTRACT

A key ring and/or chain holder for retaining keys in a position where they can be readily located and easily removed when desired has a bracket arranged for being fixed to a support member and releasably receiving an attaching member having at least one key fastened to it for connecting the key to the bracket. The bracket is provided with a longitudinally extending key-slot having a longitudinal opening communicating with an enlarged inner portion which retainingly receives a head terminating an elongated neck of the attaching member. By making the smallest dimension of the head greater than the transverse width of the longitudinal opening, and greater than a restricted end of the inner portion of the key-slot, and by providing shoulders on a body portion of the attaching member, the head only can be entered into and withdrawn from the key-slot only from the unrestricted end of the key-slot, thus assuring retention of the attachment member, and associated key, on the bracket. The latter can be mounted on an inner wall surface of a woman's handbag, and the like, as by a double-faced adhesive pad.

5 Claims, 6 Drawing Figures

KEY RING AND/OR CHAIN HOLDER

BACKGROUND OF THE INVENTION

1. Field of the Invention

This invention relates generally to a key holder, and particularly to a key holder mountable on an inner surface of a lady's handbag, and the like.

2. Description of the Prior Art

It is frequently difficult to locate keys and similar objects placed in a woman's handbag, purse, and the like, when it is desired to remove the key from the bag for use. Accordingly, it is generally known to provide a key container device attachment for mounting in a purse, wallet, and like container, which permits a key to be easily located and removed from the container for use whenever desired.

U.S. Pat. Nos. 3,326,258, issued June 20, 1967 to L. L. Stucker, 3,415,300, issued Dec 10, 1968 to G. S. Worcester, and 3,682,216, issued Aug. 8, 1972 to L. M. Nelson, show that it has heretofore been generally known to provide a bracket or anchor member which is adhesively or otherwise affixed to the interior surface of a purse, together with a releasably attachable member provided with a key on a key chain or key ring.

The critical criteria for key holders as discussed above is that the key be reliably retained in a predetermined location within the handbag or similar receptacle while being stored in the receptacle, but can be readily and easily removed from the container when it is desired to use the key. One manner of achieving the desired usual retention and easy removal for use is to attach the key or keys directly to a key carrier in a semi-permanent manner, and provide a suitable arrangement for releasably attaching the key carrier to a holder. An example of such an arrangement can be found in U.S. Pat. No. 2,679,674, issued June 1, 1954 to A. N. Hanna.

SUMMARY OF THE INVENTION

It is an object of the present invention to provide a key ring and/or chain holder which will reliably retain keys, and the like, in a position where the keys can be readily located and easily removed when desired.

It is another object of the present invention to provide a key holding device constructed from a pair of cooperating elements interegageable with one another in a manner which virtually assures retention of the keys in a predetermined location, while permitting the keys to be readily located and easily removed for use as desired.

These and other objects are achieved according to the present invention by providing a key ring and chain holder having: a bracket arranged for being fixed to a support member; an attaching member releasably attached to the bracket and to at least one key, as by a key ring or chain, for detachably connecting the key to the bracket; and a connecting arrangement associated with the bracket and with the attaching member for attaching the attaching member to the bracket in such a manner as to normally reliably secure the attaching member to the bracket, while permitting easy removal of the attaching member from the bracket when it is desired to use the key or keys.

According to a preferred embodiment of the invention, the connecting arrangement includes a longitudinally extending key-slot provided in the bracket, with the key-slot having a longitudinal slot provided completely across a face of the bracket and communicating with an enlarged inner portion of the key-slot formed in the bracket. The inner portion of the key-slot extends through the bracket parallel to the face of the bracket in which the opening is provided, with openings in the bracket terminating the inner portion on end faces of the bracket. One of the holes thus formed in the end faces of the bracket is restricted relative to the inner portion of the key-slot for a purpose to become clear below.

The connecting arrangement further includes an elongate neck portion provided on the attaching member and terminating in an enlarged head formed to mate with the inner portion of the key-slot. The smallest dimension of the head of the elongate neck portion is advantageously greater than a transverse width of the longitudinal opening in order to prevent insertion and removal of the head from the inner portion of the key-slot by way of the longitudinal opening partly forming the key-slot. Further, a body portion of the attaching member forms shoulders that prevent removal of the head, and neck portion, of the attaching member from the key-slot except in a prescribed relationship and relative movement between the attaching member and associated bracket.

As will be appreciated, the longitudinal slot is dimensioned to receive the section of the elongate neck portion immediately adjacent the head which terminates the elongate neck portion in order to permit the head to slide within the inner portion of the key-slot.

A particularly advantageous feature of the present invention is the provision of an attaching arrangement associated with the bracket for facilitating the affixing of the bracket to a support surface. In particular, it is contemplated to use a double-faced adhesive pad adhered to a face of the bracket parallel to the face provided with the slot of the key-slot and adherable to the associated support surface.

These and other objects and advantages of the invention will become subsequently apparent from the details of construction and operation of the invention as more fully described and claimed below.

BRIEF DESCRIPTION OF THE DRAWINGS

FIG. 1 is a perspective view, partly cut away and in section, showing a key ring and/or chain holder according to the present invention mounted within a lady's handbag, and the like;

DESCRIPTION OF THE PREFERRED EMBODIMENT

Figure 1:
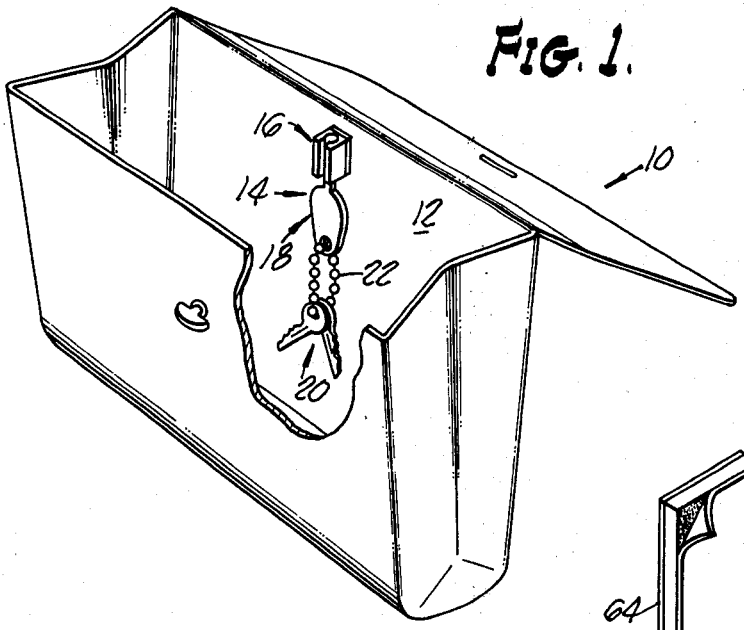

Referring now more particularly to FIG. 1 of the drawings, a woman's handbag 10, and the like, is illustrated as having an inner wall surface 12 on which is mounted a key ring and/or chain holder 14 according to the present invention. Since the handbag 10 itself is of conventional construction, and since the construction of the handbag 10 does not form part of the present invention, the manner of construction of the handbag 10 will not be discussed herein.

Holder 14 includes a bracket 16, which is advantageously in the form of the illustrated substantially rectangular block, capable of being affixed to a support member such as wall surface 12 of handbag 10. Holder 14 further includes an attaching member 18 releasably attached to bracket 16 and to at least one key, with a pair of keys 20 being illustrated, for detachably connecting the key or keys to bracket 16. As shown in FIG. 1, keys 20 are connected to attaching member 18 by a conventional key chain 22. It will be appreciated that, while not specifically illustrated, a conventional key ring, and the like, may be substituted for chain 22.

Referring now more particularly to FIGS. 2–5 of the drawings, a connecting arrangement 24 is associated with bracket 16 and attaching member 18 for attaching the attaching member 18 to bracket 16 in a releasable yet reliable manner. Arrangement 24 includes a longitudinally extending key-slot 26 provided in bracket 16. Key-slot 26 extends between the ends of the bracket 16 and has a straight slot portion 28 forming an opening the full length of a face 30 of bracket 16 and communicating with an enlarged inner portion 32 of key-slot 26. Inner portion 32 extends longitudinally through bracket 16 parallel to face 30, and terminates in openings 34 and 36 provided in ends 38 and 40 of bracket 16. A pair of cooperating an opposed ledges 42 and 44 restrict opening 36 in end 40 of bracket 16 relative to inner portion 32 for a purpose which will become clear below.

Connecting arrangement 24 further includes an elongate neck portion 46 provided on attaching member 18 and terminating in an enlarged head 48 formed to mate with inner portion 32 such that head 48 will slide within inner portion 32. The smallest dimension of head 48 is greater than a transverse width of longitudinal slot 28 formed in bracket 16 in order to prevent insertion or withdrawal of head 48 to and from inner portion 32 other than by opening 34 provided in end 38 of bracket 16. As will be appreciated, the section of neck portion 46 immediately adjacent head 48 will be dimensioned so as to slide within slot 28 and permit the desired sliding movement of head 48 within inner portion 32.

Attaching member 18 can be in the illustrated substantially planar, paddle configuration provided with a key-attaching aperture 50 at a narrow end 52 and having the elongate neck portion 46 disposed at a broad end 54 opposed to end 52. Neck portion 46 extends from end 54 of member 18 in the direction directly away from end 52 of the same member. As can be readily appreciated from the drawings, the body portion 55 of member 18 tapers from broad end 54 towards the narrow end 52 in the illustrated embodiment.

Inner portion 32 of key-slot 26 is advantageously provided with an arcuate surface 56 which can be substantially cylindrical as illustrated. Head 48 will in this instance be at least the illustrated hemisphere insertable into inner portion 32 through opening 34 provided in end 38 of bracket 16, but larger than the restricted hole 36 provided in end 40 of bracket 16 and the slot 28 provided in face 30 of bracket 16 in order to restrict removal of head 48 from the socket formed by inner portion 32 other than through the aforementioned opening 34. As perhaps can best be seen from FIG. 3 of the drawings, neck portion 46 and head 48 of attaching member 18 are insertable into key-slot 26 at substantially a right angle to the longitudinai extent of key-slot 26. This is illustrated by the broken lines in FIG. 3. Once inserted, attaching member 18 may be swung substantially 90° about head 48 in order to place member 18 in the position shown in full lines in FIG. 3 of the drawings. As will be appreciated, slot 28 communicates with inner portion 32 in both of the ends 38 and 40 so as to permit neck portion 46 to swing into the lower, or restricted, end 40 of block 16 to assume the full line position shown in FIG. 3.

In order to make attachment of member 18 with bracket 16, head 48 is inserted at the upper end of key-slot 26, or end 38 of bracket 16, and is then moved down until head 48 engages against the supporting shoulders or ledges 42 and 44 disposed at the lower end of key-slot 26, or end 40 of bracket 16. Attaching member 18 is readily detachable by reversing the operation just described. Broad end 54 forms shoulders which prohibit member 18 from passing through key-slot 26, with neck portion 46 being dimensioned such that head 48 will remain in inner portion 32 when broad end 54 abuts end 40 of bracket 16. In this manner, head 48, and neck portion 36, can only be removed from key-slot 26 when broad end 54 is oriented to move relative to the bracket 16 in a direction from the end 40 to the end 38 of bracket 16.

Figure 6:
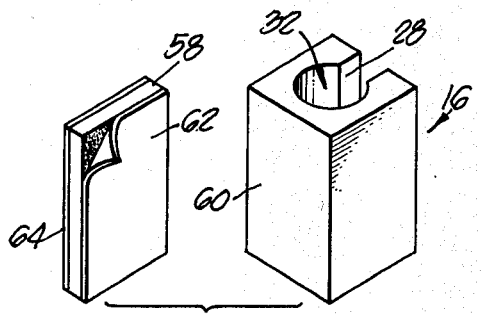
FIG. 6 is an exploded, perspective view showing a bracket and mounting pad according to the present invention.
Figure 2:
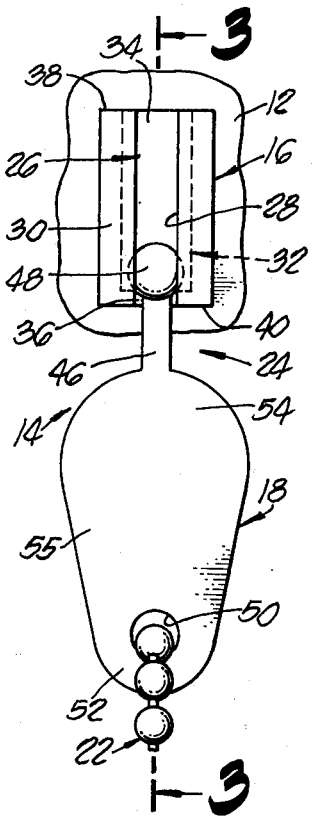
FIG. 2 is a framgentary, front elevational view showing the holder of FIG. 1, but drawn to a larger scale.
Figure 3:
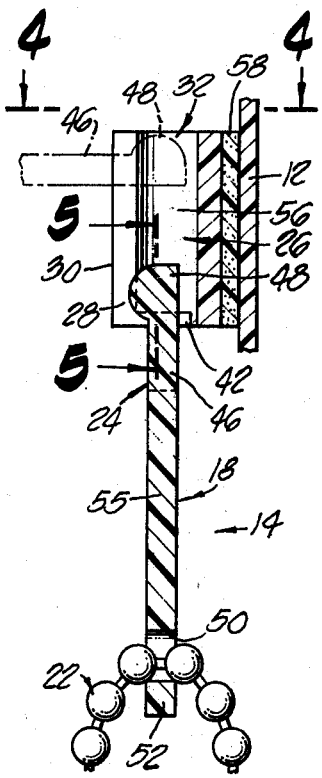
FIG. 3 is a fragmentary, sectional view taken generally along the line 3—3 of FIG. 2.
Figure 4:
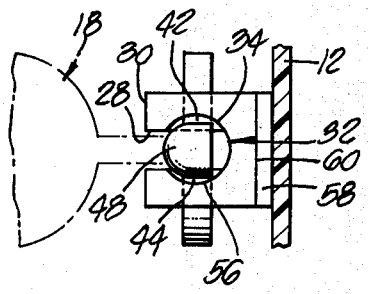
FIG. 4 is a fragmentary, sectional view taken generally along the line 4—4 of FIG. 3.
Figure 5:
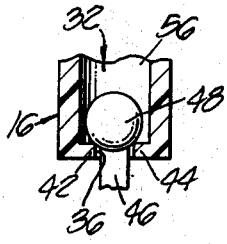
FIG. 5 is a fragmentary, sectional view taken generally along the line 5—5 of FIG. 3.

Referring now more particularly to FIG. 6 of the drawings, it is a particularly advantageous feature of the present invention to provide some arrangement associated with bracket 16 for facilitating the affixing of bracket 16 to a support surface such as inner wall surface 12 of handbag 10. As illustrated in FIG. 6, it is contemplated to employ a double-faced adhesive pad 58 of conventional construction and adhered by one of its faces to a further face 60 of bracket 16. Face 60 is preferably parallel to face 30. The other of the faces of pad 58 is then readily adherable to the support surface. As will be appreciated, the conventional removable paper covers 62 and 64 can be employed in conjunction with pad 58 in order to protect the adhesive surfaces, or faces, of pad 58 until such time as it is desired to mount bracket 16, or at least to mount pad 58 on face 60 of bracket 16. The pressure-sensitive adhesives suitable for use in constructing adhesive pad 58 are in themselves well known and conventional, and accordingly, it is not considered necessary to describe the construction of pad 58 in detail herein.

As will be appreciated from the above description and from the claims, a holder 14 according to the invention provides a simple, inexpensive, yet rugged, reliable, and efficient device for retaining keys and the like in a predetermined position where they can be readily located and easily removed when desired. While the device is particularly advantageous when in a handbag, or like receptacle, it can also be mounted on walls of rooms and like structures.

It is to be understood that the above description of the present invention is susceptible to various modifications, changes, and adaptations intended to be interpreted within the meaning and range of equivalents of the appended claims.

I claim:

1. A key holder, comprising:

a. an elongated bracket of block-like configuration arranged for surface attachment in an upright position to a support, said bracket having a key-slot extending between its ends, the key-slot including a straight slot portion opening into one face of said bracket and extending the full length thereof, and an enlarged inner slot portion communicating with the straight slot portion and having its ends terminating respectively at opposite ends of said bracket, and with one of the end openings being restricted; and b. a key attaching member which includes a body having a shoulder for preventing passage of the body through the key-slot, an elongate neck portion extending from said shoulder and terminating in a head portion, said head and neck portions being of a size to permit movement thereof along the key-slot with the head portion in the enlarged inner slot portion and the neck portion in the straight slot portion, and being removable from the key-slot in a direction from the restricted said one end opening to the other end opening only when the shoulder is positioned for movement in a path outwardly of said face of the bracket.

2. A key holder as defined in claim 1, wherein the attaching member has a substantially planar, paddle configuration provided with a key-attaching aperture at a narrow end and with the elongated neck portion being disposed at a broad end opposed to the narrow end, said broad end forming said shoulder, and said elongated neck portion extending from said broad end in a direction away from said narrow end.

3. A key holder as defined in claim 2, wherein the inner portion of the key-slot has an arcuate surface.

4. A key holder as defined in claim 3, wherein the bracket is a substantially rectangular block and the arcuate surface of the inner portion is substantially cylindrical, with the head of the elongated neck portion of the attaching member being at least a hemisphere insertable into the inner portion of the key-slot through the other of the openings provided in the bracket, but larger than the restricted one of the openings provided in the bracket and larger than the straight slot portion of the key-slot.

5. A key holder as defined in claim 4, which includes means for attaching said bracket to said support, said attaching means comprising a double-faced adhesive pad adhered to another face of the bracket extending parallel to said one face, said pad being further adherable to a surface of the support so as to mount the bracket on the support.

* * * * *